US008336238B1

(12) United States Patent
Hines

(10) Patent No.: US 8,336,238 B1
(45) Date of Patent: Dec. 25, 2012

(54) REVERSE-DEPTH SIGNAGE

(76) Inventor: Stephen P. Hines, Glendale, CA (US)

( * ) Notice: Subject to any disclaimer, the term of this patent is extended or adjusted under 35 U.S.C. 154(b) by 0 days.

(21) Appl. No.: 13/231,921

(22) Filed: Sep. 13, 2011

Related U.S. Application Data

(60) Provisional application No. 61/382,424, filed on Sep. 13, 2010.

(51) Int. Cl.
*G09F 15/00* (2006.01)

(52) U.S. Cl. ..... 40/610; 40/539

(58) Field of Classification Search ..... 40/124.13, 40/453, 539, 610; 160/135
See application file for complete search history.

(56) References Cited

U.S. PATENT DOCUMENTS 2,725,651 A * 12/1955 Spear ..... 40/124.13
2,824,394 A * 2/1958 Lohnes ..... 40/124.13
6,306,479 B1 * 10/2001 Feiertag ..... 428/77
2002/0108281 A1 * 8/2002 Mauck ..... 40/453
2011/0185608 A1 * 8/2011 Pangborn ..... 40/453

OTHER PUBLICATIONS

Patrick Hughes, "Vanishing Venice," original artwork published prior to 2010, found at http://en.wikipedia.org/Patrick_Hughes_(artist).
Patrick Hughes, What is Reverspective, published earlier than 2010 at http: www.patrickhughes.co.uk/reverspective.htm.
Patrick Hughes, Perplexing Perspective, Artist & Illustrators, Dec. 2008, pp. 29-31, Chelsea Magazine Co., London.
The doors of perception, Antiques Magazine, Issue 1103, Week Ending Jan. 12, 2006, pp. 36-38.
Maria Louis, Perplexing Perspective, Outlook PROFIT, Apr. 17, 2009, p. 74, Outlook Group, India.

* cited by examiner

*Primary Examiner* — James Kramer
*Assistant Examiner* — Kristina Junge
(74) *Attorney, Agent, or Firm* — Roy L. Anderson; Wagner, Anderson & Bright PC

(57) ABSTRACT

A display surface is attached to a support. The display surface has a recessed element between two protruding elements and a graphic image in which depth is reversed. The display surface can be in a card, which opens like a cover or a pop-up card or an according like card, a room divider, a cardboard display or a display for a building or billboard. Spacing of the display can be controlled.

13 Claims, 20 Drawing Sheets

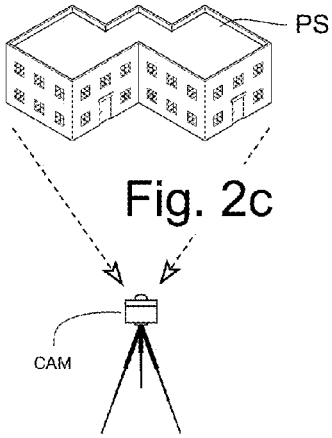
Fig. 2c
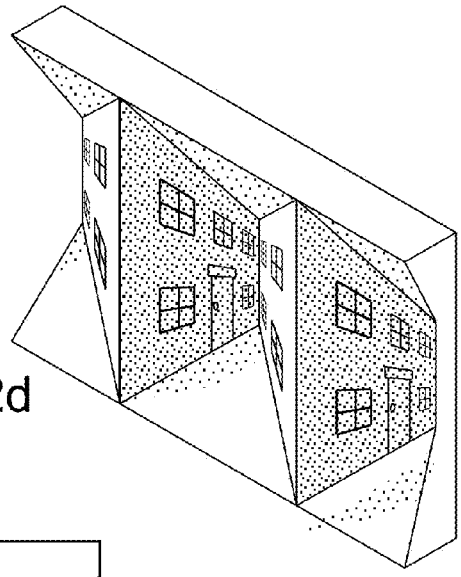
Fig. 2d
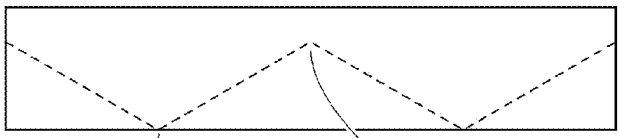
Fig. 2a
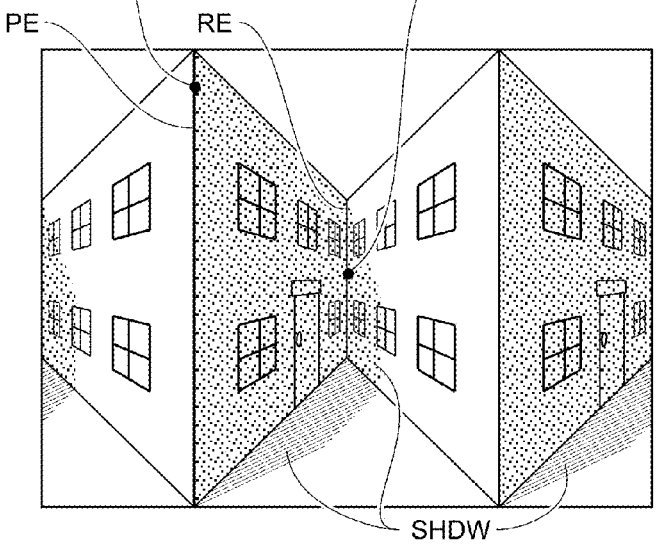
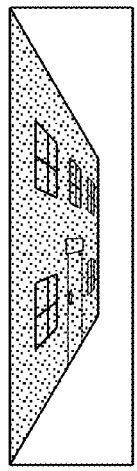
Fig. 2b
Fig. 2
PRIOR ART, CONVENTIONAL BAS-RELIEF

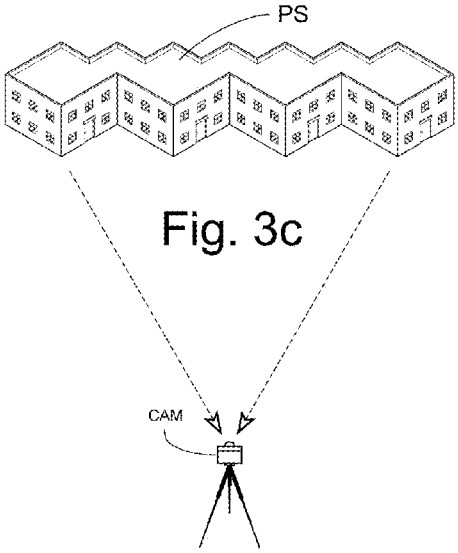
Fig. 3c
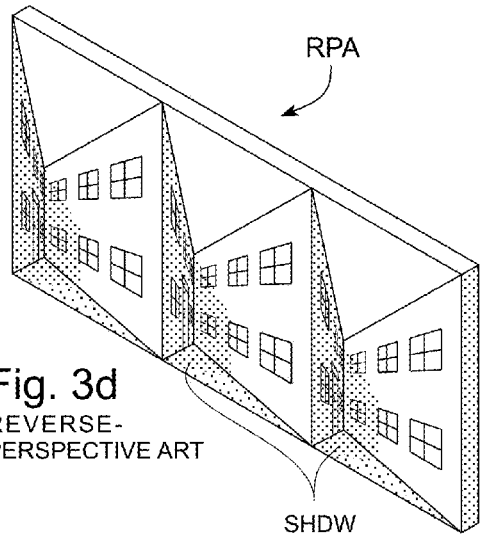
Fig. 3d
REVERSE-PERSPECTIVE ART
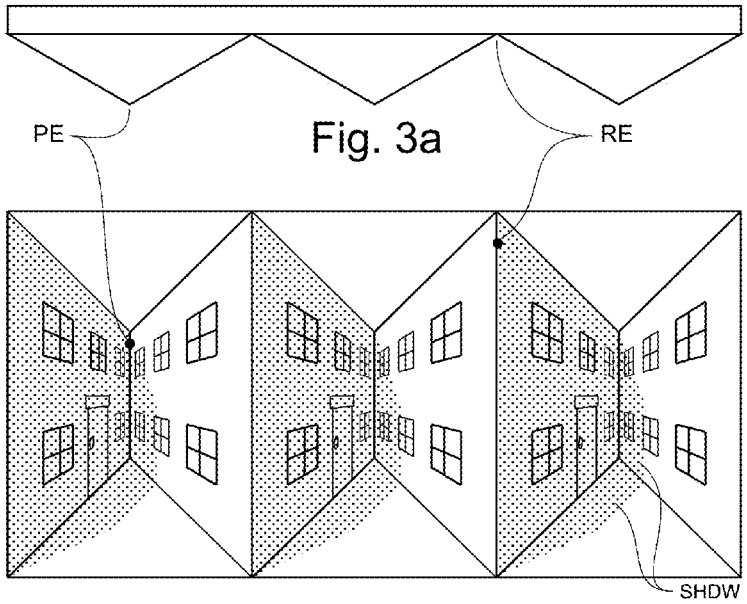
Fig. 3a
Fig. 3
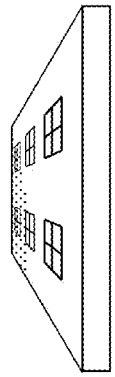
Fig. 3b

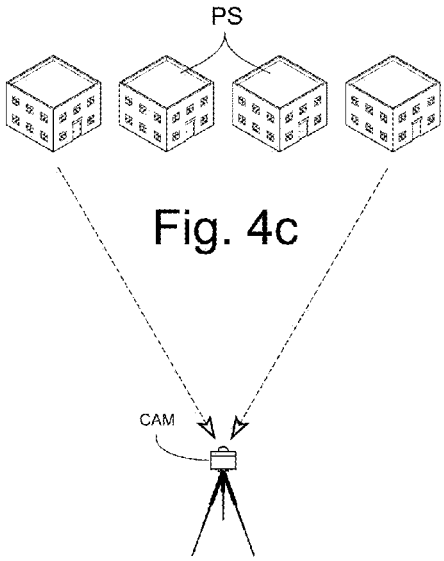
Fig. 4c
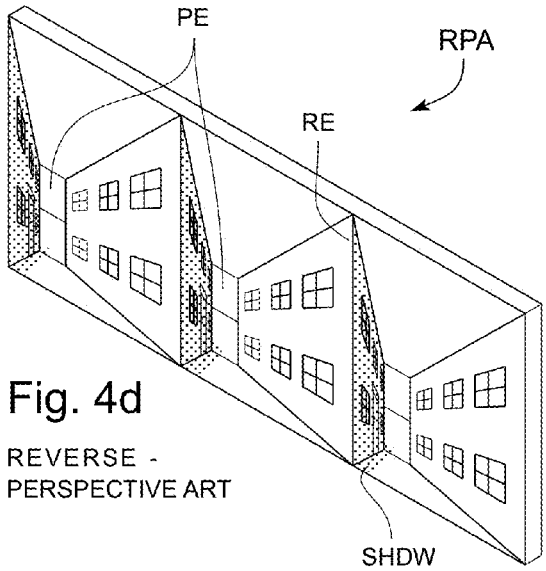
Fig. 4d
REVERSE - PERSPECTIVE ART
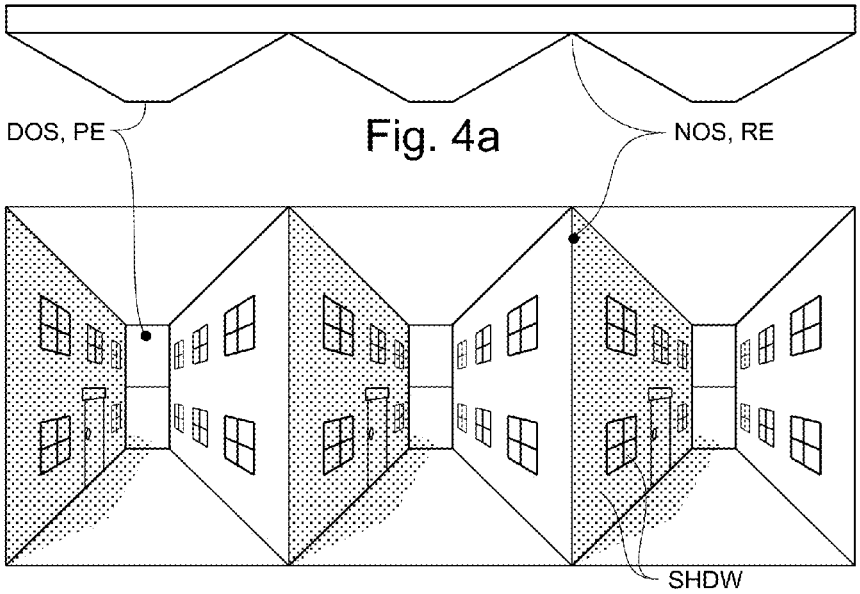
Fig. 4a
Fig. 4
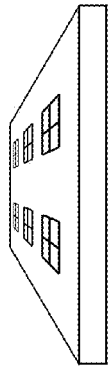
Fig. 4b

REVERSE-DEPTH SIGNAGE

CROSS-REFERENCE TO RELATED APPLICATIONS

This application claims priority from U.S. Ser. No. 61/382,424, filed Sep. 13, 2010, the disclosure of which is specifically incorporated herein by reference.

FIELD OF THE INVENTION

The field of the present invention is in commercial signage.

BACKGROUND OF THE INVENTION

Many forms of art have been developed over the years to portray scenes starting with 3,200-year-old cave drawings in France, perspective drawing in the 15th century in Italy, followed by oil paintings, and three-dimensional computer renderings today. Most paintings, drawings or computer renderings are displayed on flat surfaces; however, bas-relief carvings, on coins, plaques, and terrain maps, use shallow sculpting and motion parallax to convey depth.

Patrick Hughes is an artist in England who creates three-dimensional paintings that he calls "Reverspectives."

This patent describes commercial signage which uses reverse-depth contoured images to create an attention getting optical illusion. The illusion attracts attention because the motion parallax is opposite that which is expected.

SUMMARY OF THE INVENTION

The present invention is generally directed to an apparatus having a display surface made up of one or more display modules. Each display module has a recessed element, two protruding elements, and two surfaces joined together by the recessed element. A reverse perspective illusion is created on the two surfaces which connect the two protruding elements to the recessed element. A graphic image is displayed on the display surface having a width, a height and a depth, the depth being reversed so that a distant part of an original scene of the graphic image is protruding relative to the recessed element and a near part of the original scene is recessed relative to the two protruding elements. The display surface is attached to a support that holds it in a free-standing and upright position relative to a substantially planar bottom surface on which it rests.

Each of the two surfaces (which can be substantially planar) that make up the display surface can have a substantially irregular quadrilateral shape formed by the recessed element, a protruding element and a pair of non-parallel connecting edges, the protruding and recessed elements being substantially parallel, and multiple display modules can be joined together. A bottom point of each recessed element can rest on the substantially planar bottom surface in the free-standing and upright position. The support can be a free-standing cardboard sign with the recessed element mounted to it.

The apparatus can be a two-piece cover which can also be the support and contain the two surfaces or have additional support surfaces. The display surface can be a fan-folded insert attached to the folded cover and have a strap affixed to it to limit expansion of the folded cover to a point at which the strap is nominally straight. The cover can be joined together by an accordion insert containing the display surface whose expansion is limited by a strap which can be kept in the open position by a mechanism such as two flaps that can be folded out to create a beam. Additional triangular support surfaces can be formed in the cover to provide a rectangular appearance.

The apparatus can be a room divider with legs for support in which each display surface is contained on a panel of the room divider and each pair of panels is connected by at least one hinge while a mechanism such as a triangle can establish preferred angular spacing for hinged panels and only alternate panels have a leg at the short hinge connection.

A large display system (such as a pipe frame system) can mount one or more banners that serve as the display surface. The display system can be contained in a billboard or be mounted to a roof of a building.

The display surface can be mounted to a backboard so that each recessed element is mounted to the backboard.

Accordingly, it is primary object of the present invention to provide improved commercial signage which uses a reverse depth perspective.

This and further objects and advantages will be apparent to those skilled in the art in connection with the drawings and the detailed description of the invention set forth below.

BRIEF DESCRIPTION OF THE DRAWINGS

FIG. 2 illustrates a conventional bas relief sculpture of a three-dimensional scene while FIG. 2*a* is its top view and FIG. 2*b* is a side isometric view, FIG. 2*c* is the camera photographing the scene, and FIG. 2*d* is an isomeric view of the reverse-perspective bas relief.

FIG. 3 is a front view of a reverse-depth sculpture of a three-dimensional scene while FIGS. 3*a*-3*c* are, respectively, its top view, side view and an isometric view. FIG. 3*d* is the camera photographing the original scene.

FIG. 4 is a front view of an alternate version of a reverse-depth sculpture of a three-dimensional scene showing part of the distant scene between modules while FIGS. 4*a-c* are, respectively, its top view, side view and an isometric view. FIG. 4*d* is the camera photographing the original scene.

FIG. 14 illustrates a camera that takes a picture which is used in making the single-module reverse-perspective greeting card shown open in FIG. 14*a* in a front orthographic view, while

FIG. 15 illustrates a camera that takes a picture which is used in making the single-module reverse-perspective greeting card shown open in FIG. 15*a* in a front orthographic view, while

FIG. 16 illustrates a camera that takes a picture of books used in making the double-module reverse-perspective greeting card shown in FIG. 16*a* in a front orthographic view, while

FIG. 20 is a top orthographic view of an open expanded triple-module greeting card, showing fan-folded insert, and outer cover (incorporating front, back and strap) while

FIG. 23 illustrates a reverse-perspective room divider from a front view while

FIG. 24 illustrates a rear view of the room divider while FIG. 24*a* is its top view.

DETAILED DESCRIPTION OF THE PRESENT INVENTION

There are seven known depth cues, with stereopsis being the strongest, followed by motion parallax, and perspective (lines converging toward vanishing points). In any normal 3D-rich scene, with multiple objects, as the viewer moves past the scene, these depth cues will be consistent to reinforce and confirm the depth of the scene and the physical relationship of objects (i.e., close objects are larger and when the viewer moves to the left, the foreground objects move to the right relative to the more distant objects).

Described here is a signage or display technique which plays perceptual tricks on the mind by ignoring some of the traditional depth cues. The signage of this invention uses reverse depth bas relief so that as a viewer moves past the sign, whereas the size of objects in the scene are as expected, the close objects of the original scene are recessed, and more distant objects in relief. When the viewer moves past the signage, the image appears to warp in a very attention getting way because the depth cues (the object size, and the motion parallax) are inconsistent. This eye-catching effect provides a powerful basis for commercial advertising.

The ideal location for these reverse-depth signs is where people move horizontally past them—e.g., in a store seen by people walking past in the shopping mall or on a sidewalk, or in airport corridors beside people on horizontal conveyors.

In the Figures and the following description, letter designations indicate various features of the invention, with like letter designations referring to like features throughout both the drawings and the description. Although the Figures are described in greater detail below, the following is a glossary of the elements identified in the Figures.

GLOSSARY

| | |
|---|---|
| ALT MOD | Alternate mode |
| BRB | Barb on elastic cord |
| BILB | Billboard |
| BKBD | Backboard |
| BLDG | Building |
| CAM | Camera |
| DOS | Distant part of Original Scene |
| EC | Elastic Cord |
| EYL | Eyelets |
| EXC | Expanding Greeting Card |
| FLC | Folding Greeting Card |
| FLD | Fold Line |
| FLP1 | Flap #1 |
| FLP2 | Flap #2 |
| FRM | Frame |
| FS | Folded Sign |
| GCC | Greeting Card Cover |
| GCI | Greeting Card Insert |
| GCP | Greeting Card Panels (1-6) |
| GT | Glue Tab |
| HNG | 2-way Hinge |
| HOL | Hole |
| LL | Long Leg |
| MOD | Module |
| NTCH | Notch |
| NOS | Near part of Original Scene |
| PB | Printed Banner |
| PE | Protruding Element |
| PS | Photographic Subject |
| RD | Room Dividers |
| RE | Recessed Element |
| RF | Roof |
| SER | Serrations |
| SHDW | Shadow |
| SGT | Strap Glue Tab |
| STHL | Staple Hole |
| STPL | Staple |
| STRP | Strap |
| SUN | Sun |
| TP | Top Panel |

Figure 1:
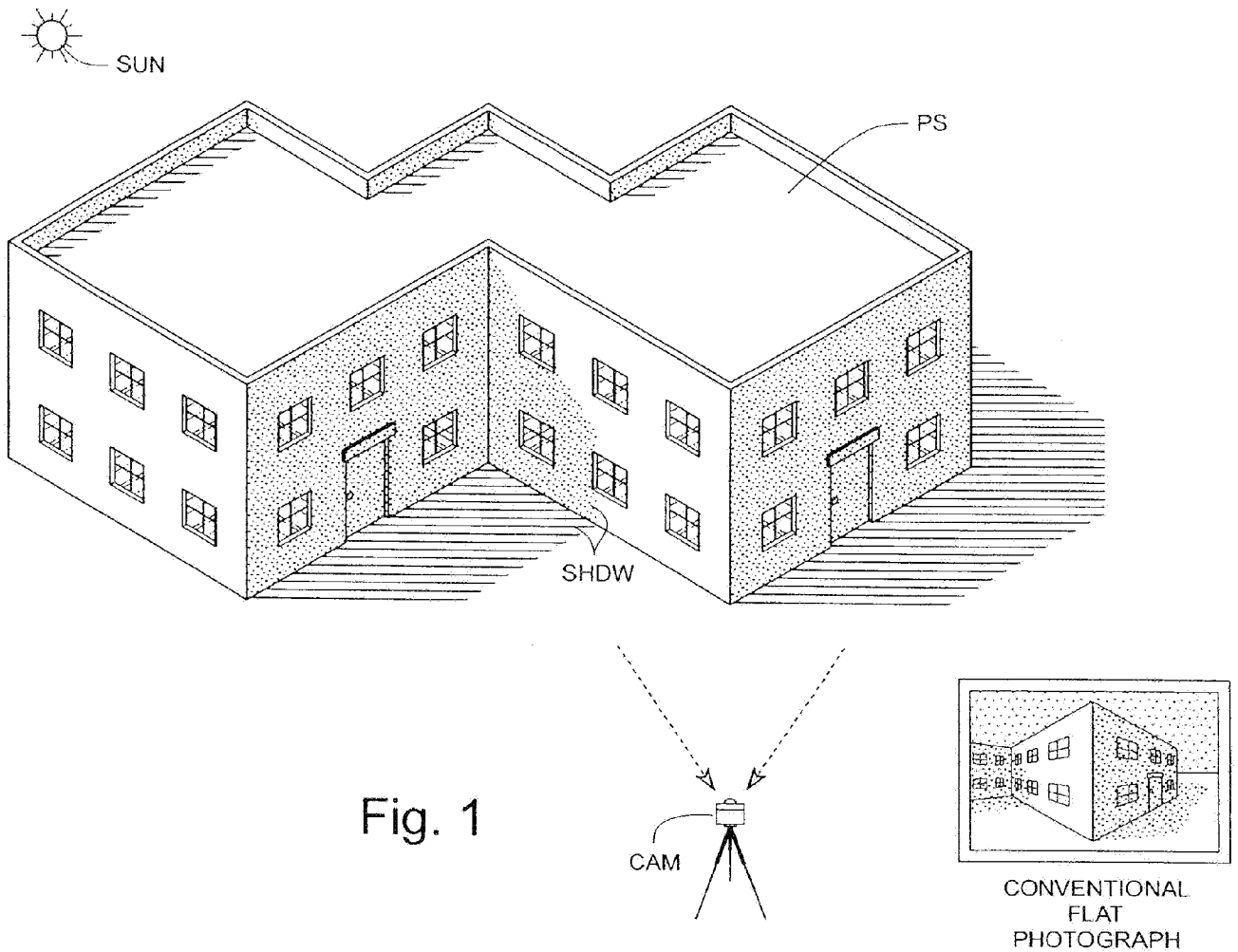
Fig. 1 Prior Art
FIG. 1 illustrates prior art, conventional photography and a 2-D photograph.

If a camera is set up facing a photographic subject PS, for example, building BLDG, shown in reference FIG. 1, a near part of the original scene NOS will appear large in the photograph, and a distant part of that original scene DOS will appear smaller in the picture, with the front and side of the building being trapezoidal shapes in the photograph, as shown in FIG. 1.

As prior art, if a traditional bas-relief image, FIGS. 2 and 2*b*, is made of that picture the near part of the scene NOS will protrude, and the distant part of the original scene DOS will be recessed, with the front and side shown on sloping trapezoid planes in the relief picture. This is the principle used to make terrain maps where the mountains protrude.

The reverse-depth bas-relief signage of this invention plays a perceptual trick by reversing the Z axis, the depth. The image's X and Y axes (width and height) are normal; however, the depth, the Z axis, is reversed so that the near objects closest to the camera NOS, in the example above, are recessed in the picture, and the distant objects DOS are in relief, as shown in FIG. 3. FIG. 4 illustrates an alternate version of FIG. 3 in which part of the distant scene is shown in a planar face that is part of the protruding element between adjacent modules. (For ease of understanding, this alternative version will not be shown in the preferred embodiments described hereinafter.)

When the viewer moves laterally, the scene appears to bend and warp in a counter-intuitive way. The combination of perspective and motion parallax override the stereoscopic depth cue. The overall effect is very compelling and attracts and holds the viewer's attention. This makes the technique very useful for commercial signage.

The technique works best with rectangular objects, boxy or flat products (buildings, books, refrigerators, computers, box cameras, cell phones, etc.) which appear as tapered or keystone shapes in a perspective view.

Figure 5:
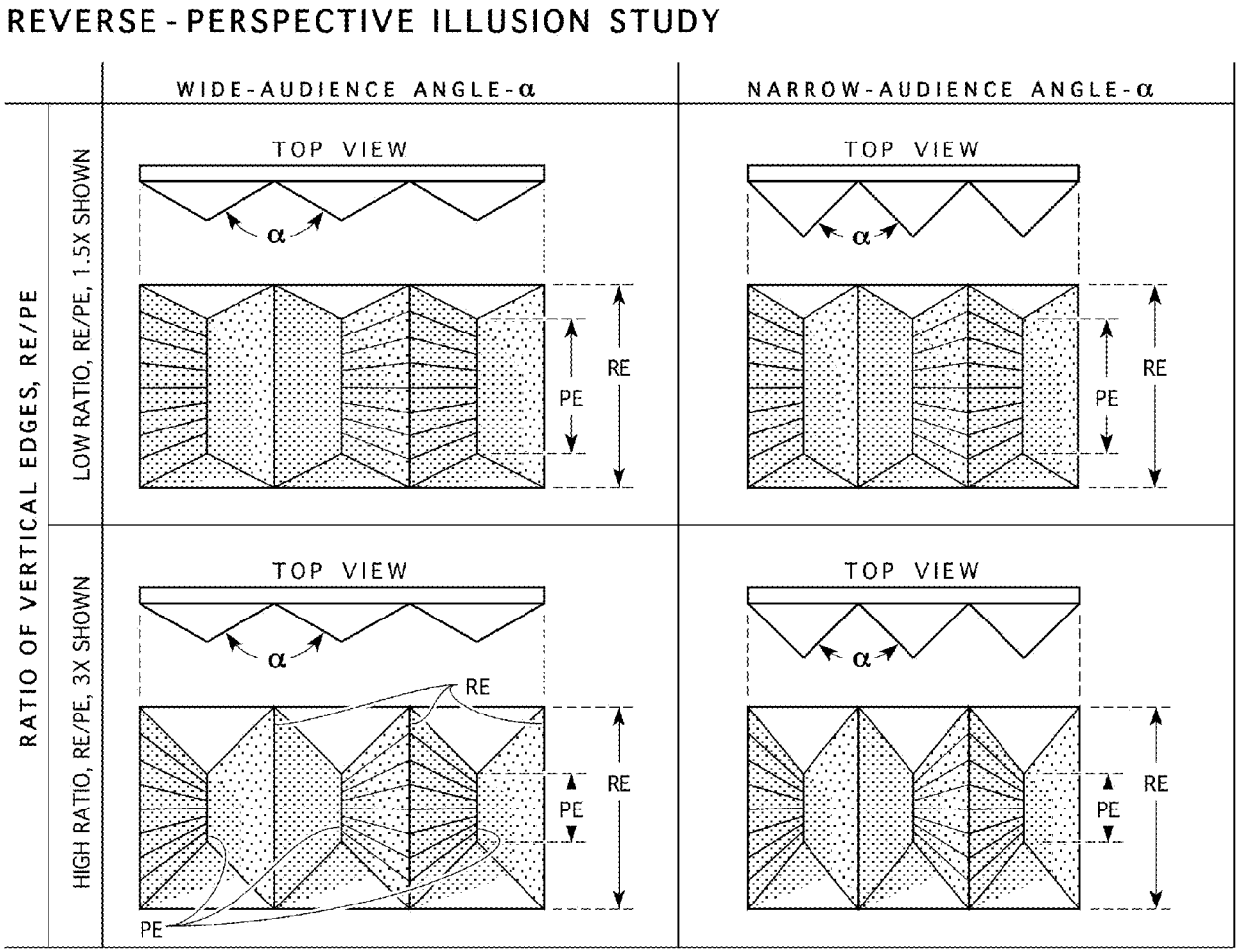
FIG. 5 is a reverse-perspective illusion study.

To determine the properties that are most effective in the illusion, FIG. 5 is a study to compare the effect of exaggerating or minimizing the physical depth and therefore the audience angle. By increasing the physical depth, the sign appears to spin faster as the viewer walks past; however, this decreases the audience angle. This stands to reason; if the sign were flat, there would be no spin or false depth to catch the viewers' attention. FIG. 5 also compares the change in the amount of perspective by altering the ratio of the height of the vertical protruding elements PE and recessed elements RE, which correspond to DOS and NOS in FIGS. 3 and 4. The optimal combination is subjective; however, the version in the top-left section of the study is especially preferred. It is especially preferred that the vanishing point of the scene is at the height of the eyes of a viewer.

Figure 23A:
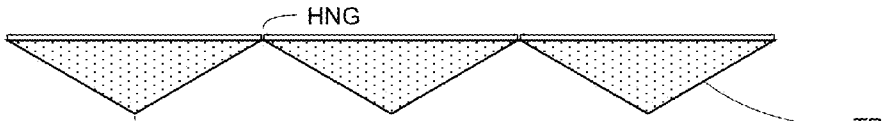
FIG. 23*a* is its top view and FIG. 23*b* illustrates a panel of the room divider.
Figure 23B:
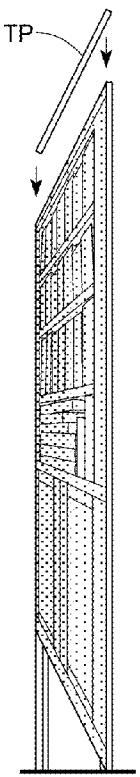
Figure 23:
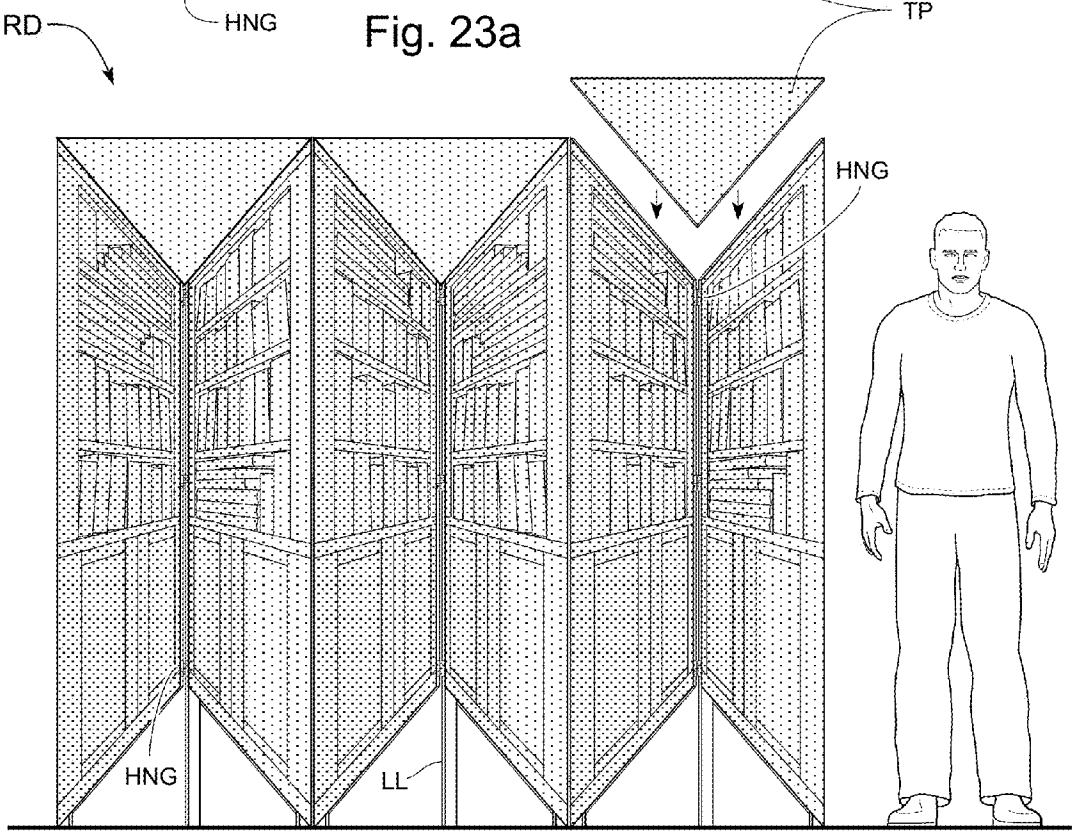

The signs of the present invention will generally have one or more display modules. Each display module will have a recessed element (which can be an edge or two edges joined together such as shown in FIG. 23). The recessed element will be the portion of the signage located farthest from a viewer. Radiating outwardly from the recessed element will be two surfaces that will extend to two protruding elements, one on each side. The protruding elements can be thought of as edges of the surfaces and they will join other edges between adjacent modules (or be connected to a planar face if an embodiment such as FIG. 4 is being used). It is especially preferred that the two surfaces be substantially planar and of a substantially trapezoidal shape, the recessed and protruding element being substantially parallel. This particular shape is easy to manufacture and helps promote the reverse perspective illusion sought by the present invention. When the surfaces of a display module are trapezoidal it is possible, although not required, to use triangular additions so as to eliminate the gap between the display surfaces and the background. If this is done, it is especially desirable that any graphics or color included on such triangles be chosen so as to compliment, but at least so as to not detract from, the reverse perspective illusion. Thus, for example, if an original scene includes sky and a foreground of grass, a top triangle might have the sky color and a bottom triangle might have the grass color.

Figure 15C:
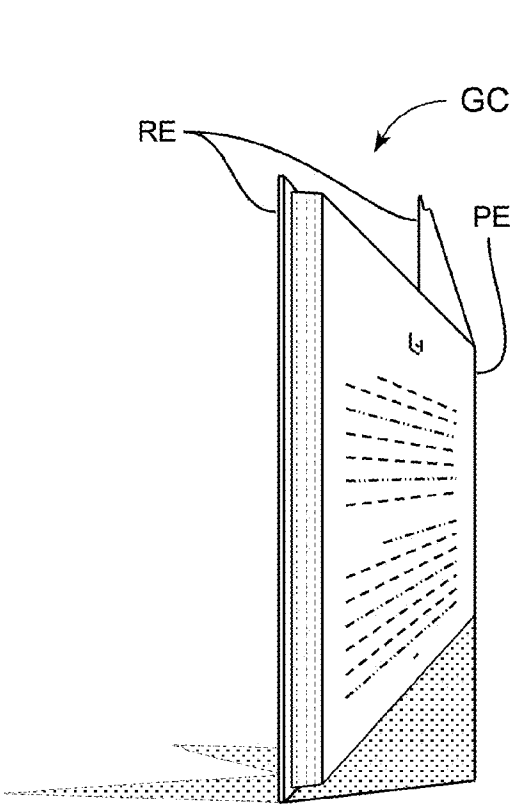
Figure 15B:
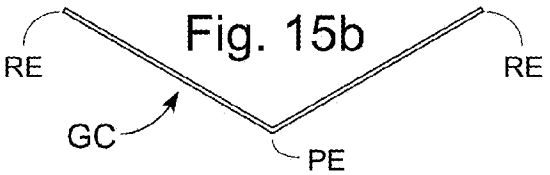
FIG. 15*b* is a top orthographic view of FIG. 15*a* and FIG. 15*c* is a perspective view of FIG. 15*a*. Note that the greeting card shown in FIGS. 15*a-c* is an alternative embodiment to that shown in FIG. 14*a*.
Figure 15A:
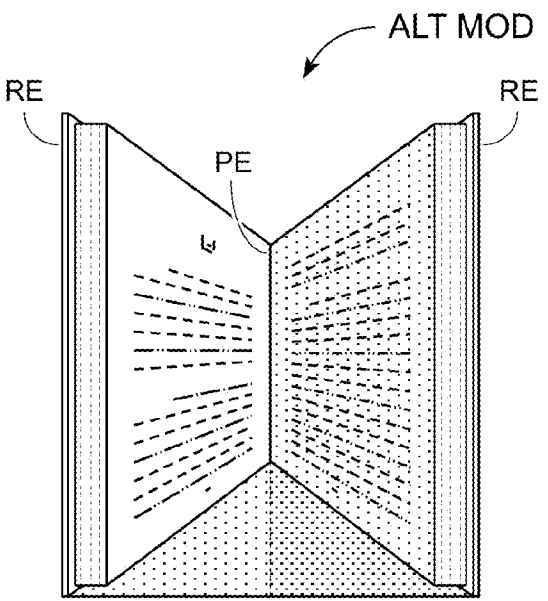
Figure 15:
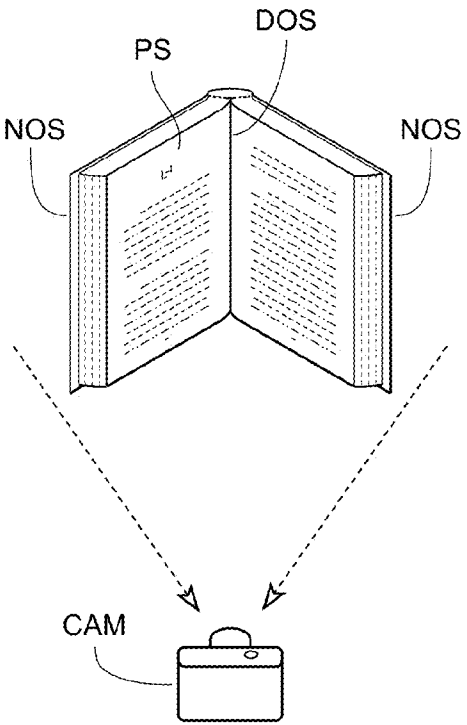

It is especially preferred that the signs of the present invention have protruding elements at their left and right ends, rather than ending in recessed elements. This creates a better reverse perspective illusion. It is especially preferred that a graphic image be displayed on two adjoining surfaces of a module to create a more effective reverse perspective illusion. Of course, one could still create signs according to the teachings set forth herein in which graphic images on adjoining surfaces of a module are not mated together, and end the signs with one or two recessed elements instead of protruding elements—they will simply create a less effective and less satisfying reverse perspective illusion. However, it should be noted that a special case exists where this is not necessarily the case, which is ALT MOD shown in FIG. 15*a*. Note that the photographic subject is simple, depicted as a book partly open, so the reverse-perspective ALT MOD shown in FIG. 15*a* relies upon a middle protruding element PE and two recessed edges RE, which appear reversed in the reverse-perspective ALT MOD. Also note that the display module in reverse-perspective ALT MOD is a substantially irregular quadrilateral shape, even though it does not have just four linear edges.

Because the signs of the present invention have physical depth, traditional flat-sign making techniques are not adequate. Hand painting will make the signs prohibitively expensive. What is needed is an inexpensive manufacturing process to create these signs.

Figure 6A:
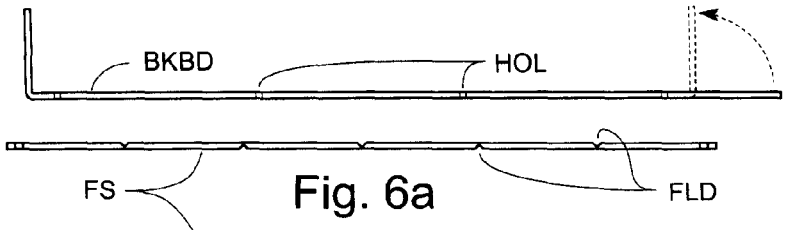
FIG. 6*a* is a top view of the flat backboard, and printed and die-cut cardboard used to construct a reverse-perspective sign.
Figure 6:
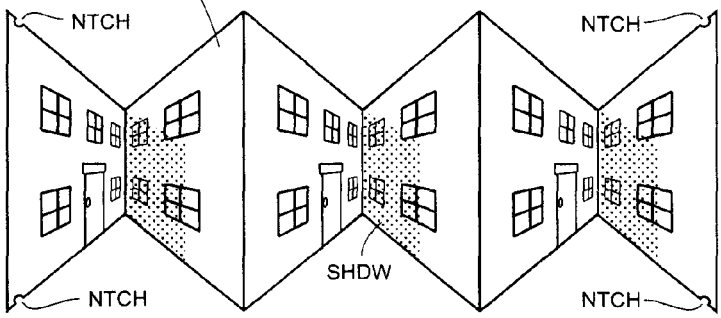
FIG. 6 is a front view of a flat backboard, and printed and die-cut cardboard used to construct a reverse-perspective sign.
Figure 6B:
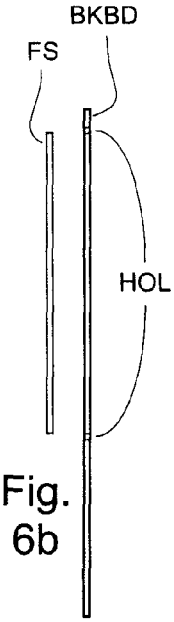
FIG. 6*b* is a side view of the flat backboard, and printed and die-cut cardboard used to construct a reverse-perspective sign.
Figure 7A:
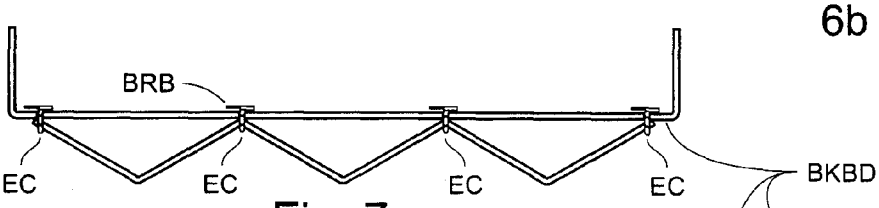
FIG. 7*a* is a top view of a reverse-perspective sign assembled by attaching a printed, die-cut and folded cardboard held to a backboard with elastic cords and barbs.
Figure 7:
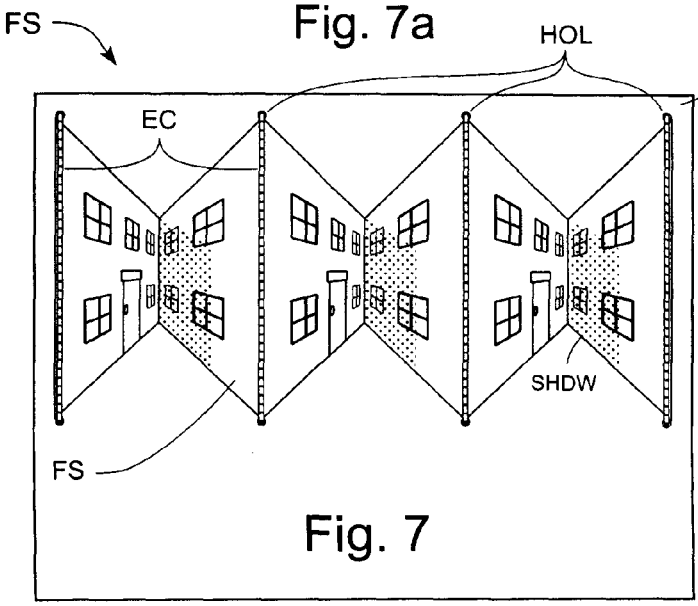
FIG. 7 is a front view of a reverse-perspective sign assembled by attaching a printed, die-cut and folded cardboard held to a backboard with elastic cords and barbs.
Figure 7B:
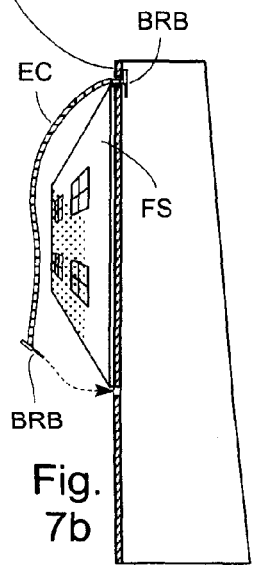
FIG. 7*b* is a side view of a reverse-perspective sign assembled by attaching a printed, die-cut and folded cardboard held to a backboard with elastic cords and barbs.
Figure 8:
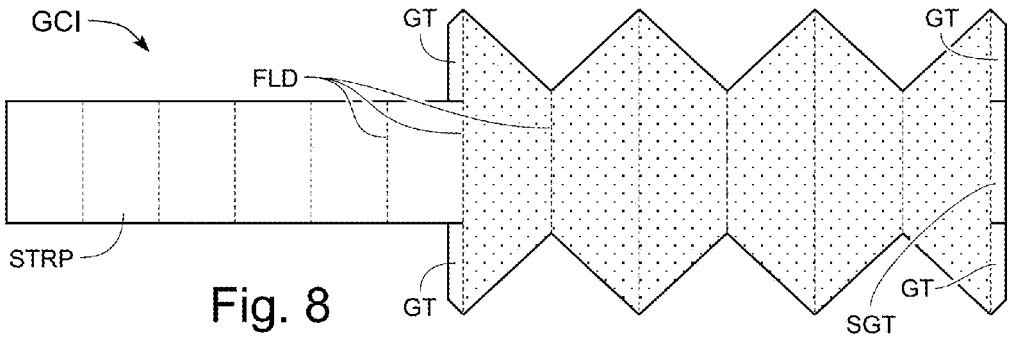
FIG. 8 illustrates a flat (unfolded) printed greeting-card insert with width-limiting strap, and glue tabs.

Certain advertising markets require that the manufacturing costs are kept low. One example is movie theaters which heavily promote upcoming movies with large printed cardboard displays in their lobbies. These displays are shipped to theaters in flat boxes, and constructed by theater staff to be used only a few weeks until the movie has had its run. Reverse-depth folded signs FS for this purpose can be made with similar techniques using a cardboard sign, serrated or stamped with fold lines FLD, FIG. 6*a*, and attached to a flat backboard BKBD using elastic cords EC with barbs BRB affixed to the ends. The barbs are inserted through holes HOL in the backboard and when the barbs turn flat with the backboard they are trapped in the hole, in the way elastic cords are used on party masks. Two of the elastic cords naturally lie flat in the valleys of folds FLD of folded sign FS in contact with backboard BKBD, FIG. 7. The two loose ends of the folded sign are attached to the backboard by engaging elastic cords in notches NTCH, FIG. 6, in the outer panels before threading the barbs through the holes in the backboard. The tension in the elastic cord holds the front graphics to the backboard.

Figure 9:
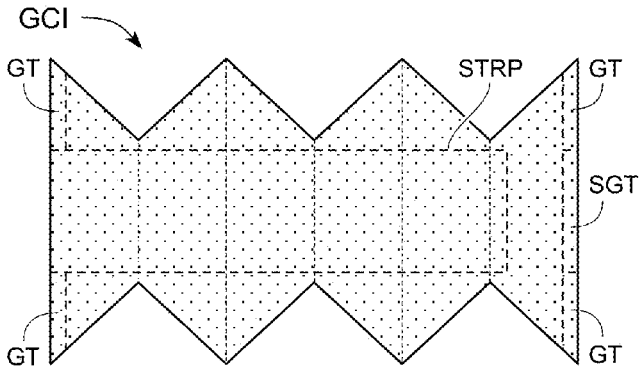
FIG. 9 illustrates a greeting-card insert showing strap and glue tabs folded around back.
Figure 10:
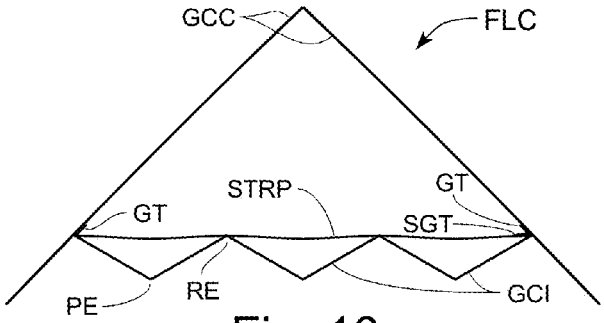
FIG. 10 is a top orthographic view of an assembled folding greeting card, opened.
Figure 11:
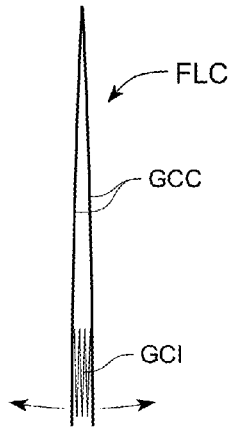
FIG. 11 is a top orthographic view of a folding greeting card, in folded closed, for mailing for insertion in an envelope for mailing.
Figure 12:
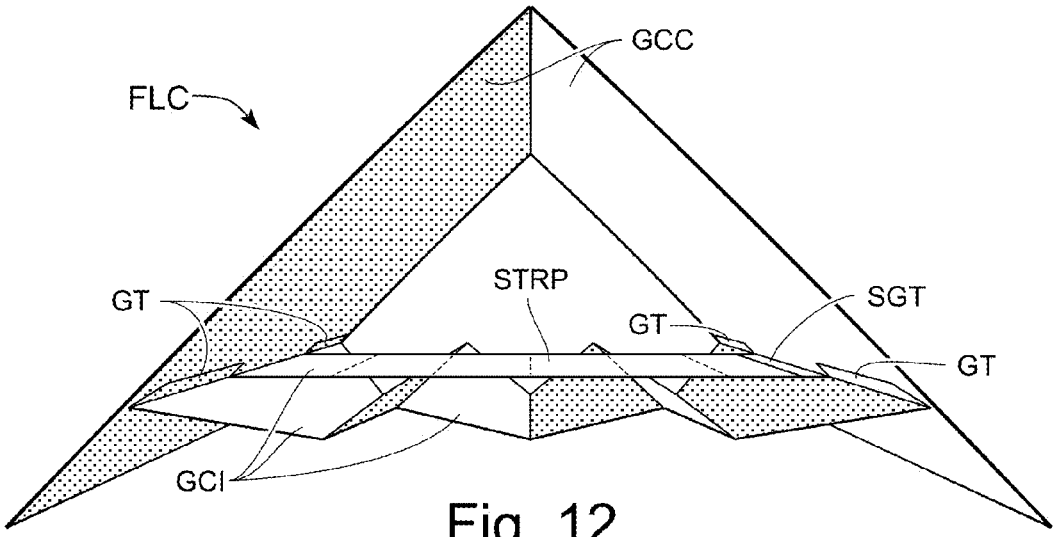
FIG. 12 is a top perspective view of a folding greeting card, open.

Reverse-perspective graphics can be incorporated into greeting cards. One form of this card, FIGS. 10, 11, 13, combines a conventional folded greeting-card cover GCC with a printed, fan-folded, reverse-perspective insert GCI glued to the interior of the folded cover. The glue tabs and strap are folded behind the graphical area, FIG. 9. The greeting-card insert GCI has several glue tabs GT, FIGS. 8, 9, 10, 12, some of which are used to attach the insert to the interior of the cover GCC, FIG. 8, 9, 10, 12. The strap glue tab SGT is attached to the free end of the strap STRP to limit the expansion of the insert GCI, FIGS. 8, 9, 12, 13. In the fully open card, the strap is nominally straight. When the card is folded, FIG. 11, the insert GCI fan folds, and the strap also fan folds in behind the insert.

Figure 13:
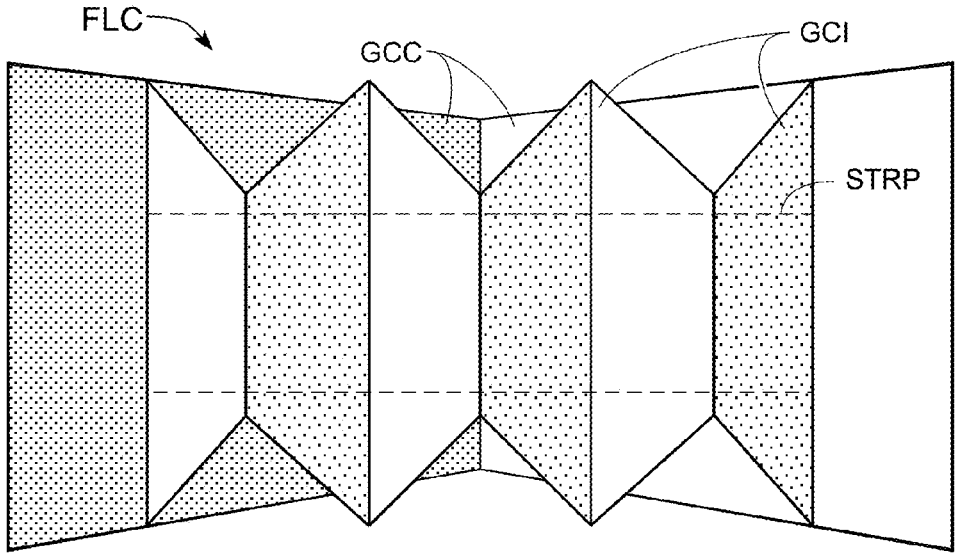
FIG. 13 is a front perspective view of a folding greeting card, open.

FIG. 13 is the perspective front view of the open folding greeting card FLC in the view the typical user would view it.

The printed insert GCI hides the strap and glue tabs. The same design can be used face up in a pop-up book.

Figure 14B:
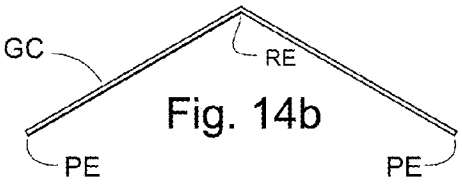
FIG. 14*b* is a top orthographic view of FIG. 14*a* and FIG. 14*c* is a perspective view of FIG. 14*a*.
Figure 14A:
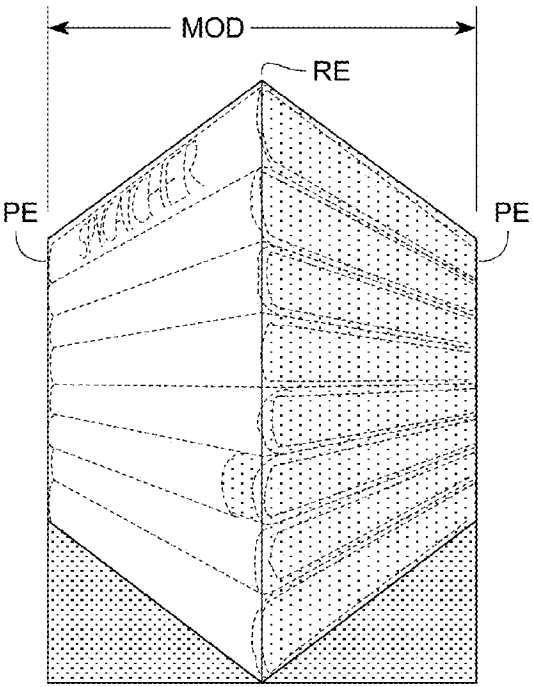
Figure 14C:
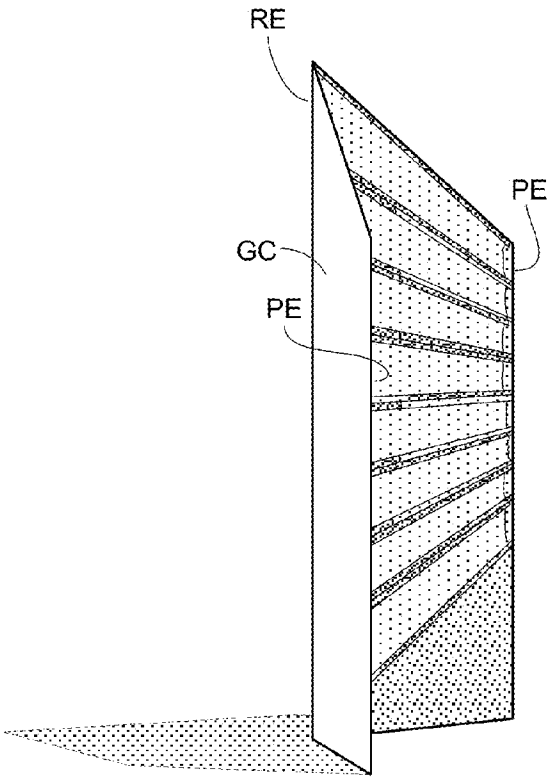
Figure 14:
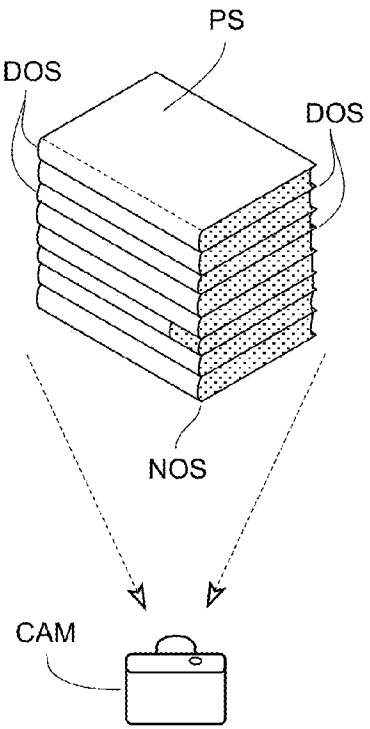
Figure 16B:
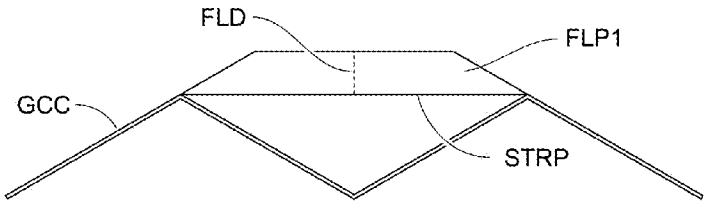
FIG. 16*b* is a top orthographic view of FIG. 16*a* and FIG. 16*c* is a perspective view of FIG. 16*a*.
Figure 16A:
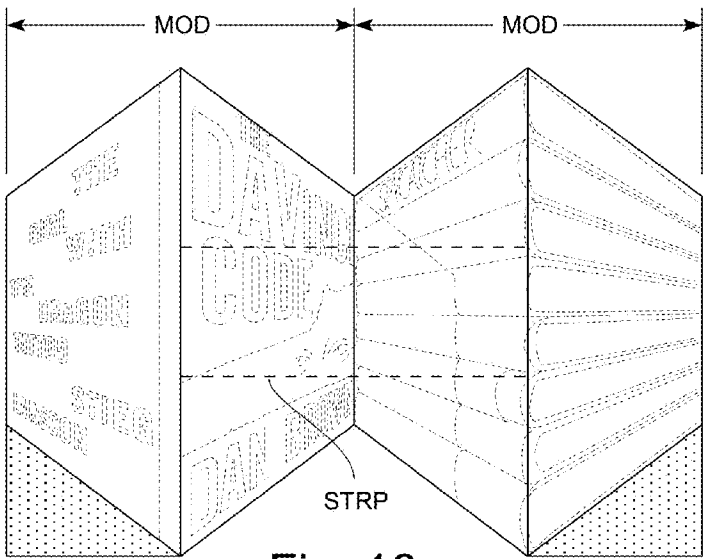
Figure 16C:
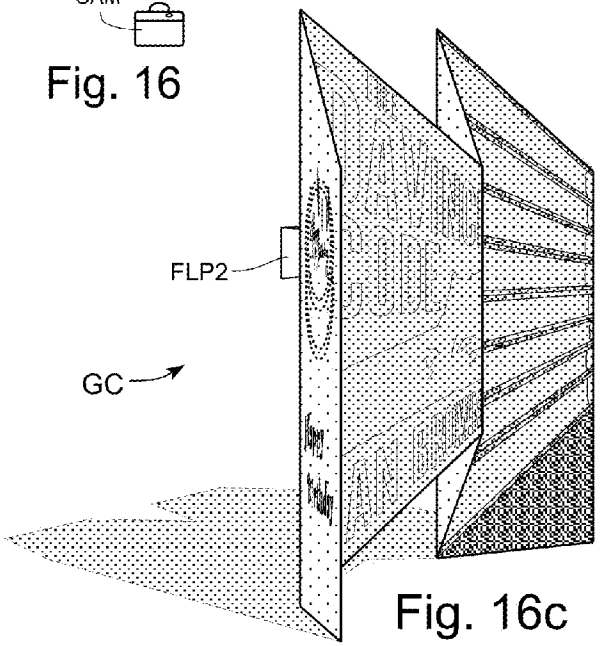
Figure 16:
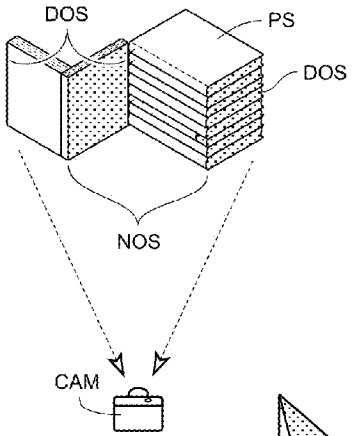
Figure 17A:
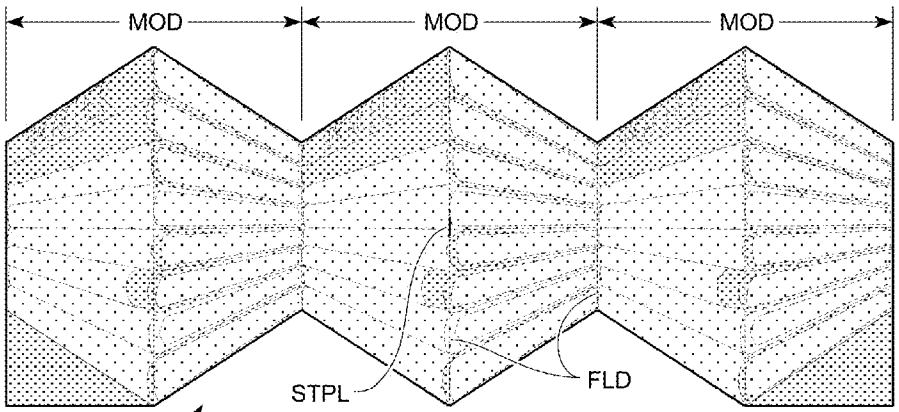
FIG. 17*a* illustrates a flat, printed, die-cut triple-module greeting-card insert.
Figure 18:
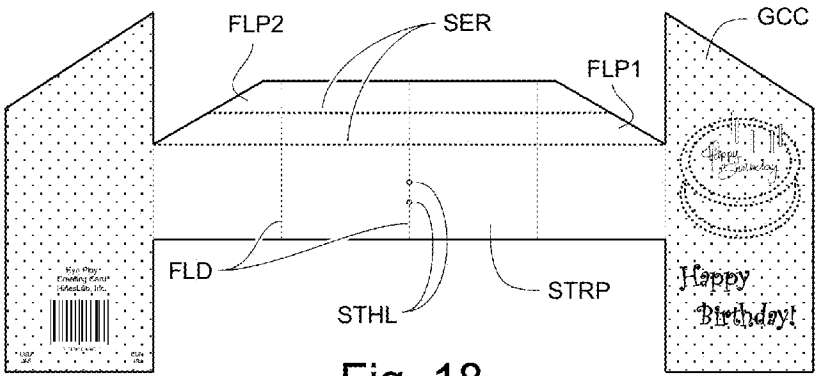
FIG. 18 illustrates a flat, printed, die-cut triple-module greeting-card outer wrap, showing front and back graphics, and width-limiting strap.
Figure 17:
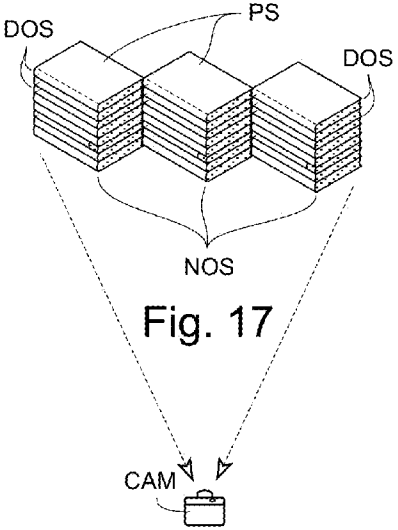
FIG. 17 illustrates a camera that takes a picture of books used in making the triple-module reverse-perspective greeting card shown in FIG. 20 in a front perspective view.
Figure 19A:
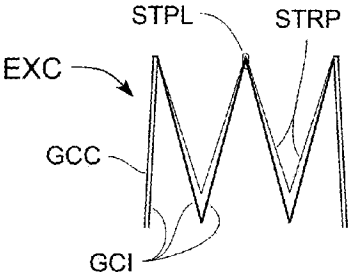
FIG. 19*a* is a partially collapsed view of the card of FIG. 20.

Reverse-perspective greeting cards can be made in another form which expands somewhat like an accordion, FIGS. 16*b*, 19*a*, 16*c*, 22. These cards can display a single reverse-perspective module FIGS. 14*a-c*, double modules FIGS. 16*a-c*, triple modules FIGS. 19-22, or more. This uses a greeting-card insert GCI, FIGS. 17*a*, 20, the ends of which are glued back-to-back to the end panels of the greeting-card cover GCC, FIG. 17*a*-22. The strap STRP, FIGS. 19, 19*a*, 20, 20*a*, 21, limits the card's expansion, to provide the best illusion. A staple STPL, FIGS. 19, 19*a*, 20, 20*a*, 21, can be used to attach the recessed fold FLD, FIG. 19, 19*a*, 20, 20*a*, 21, of the insert GCI to the strap STRP to help the insert maintain its shape.

Two stiffening flaps, FLP1, FLP2, FIGS. 18, 19, 20*a*, 21, are extensions of the strap STRP, which fan fold with the insert when mailing in an envelope; however, when the card is extended, the flaps can be folded out and down to create a beam to straighten and stiffen the strap and in general keep the card in the appropriate shape to create the intended illusion. Strap STRP is kept straight by FLP1. FLP1 is kept straight by FLP2. The three components of the beam, STRP, FLP1 and FLP2, are nominally perpendicular to their adjacent component at which angle they provide the most stiffness. FLP1 is attached to strap STRP using serrations SER so as to facilitate folding out from the strap. Similarly, FLP2 is serrated to facilitate it folding at an angle relative to FLP1 to maintain FLP1 in a straight line. Collectively, the strap and flaps FLP1 and FLP2 constitute a beam which keeps the strap straight and stiff. Without flaps FLP1 and FLP2, the card will try to collapse with the strap folding in behind the insert, and the card will not want to stand up. Thus, it is especially preferred that such flaps, or another mechanism that performs the same function of providing stability and aligning the display surfaces at a desired position, be used whenever two or more modules are used together.

Figure 20A:
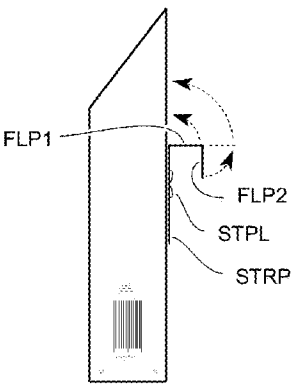
FIG. 20*a* shows the greeting card partially closed.
Figure 19:
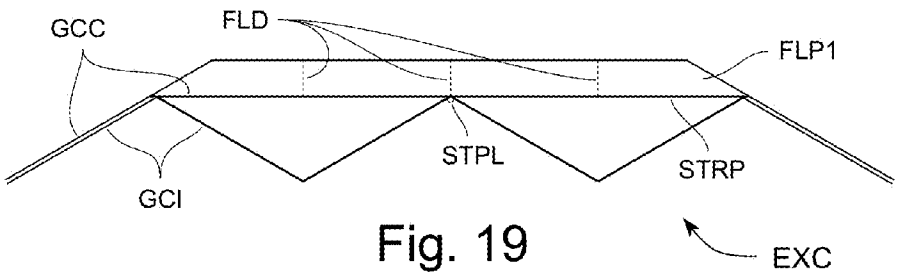
FIG. 19 is a top orthographic view of the assembled card of FIG. 20.
Figure 20:
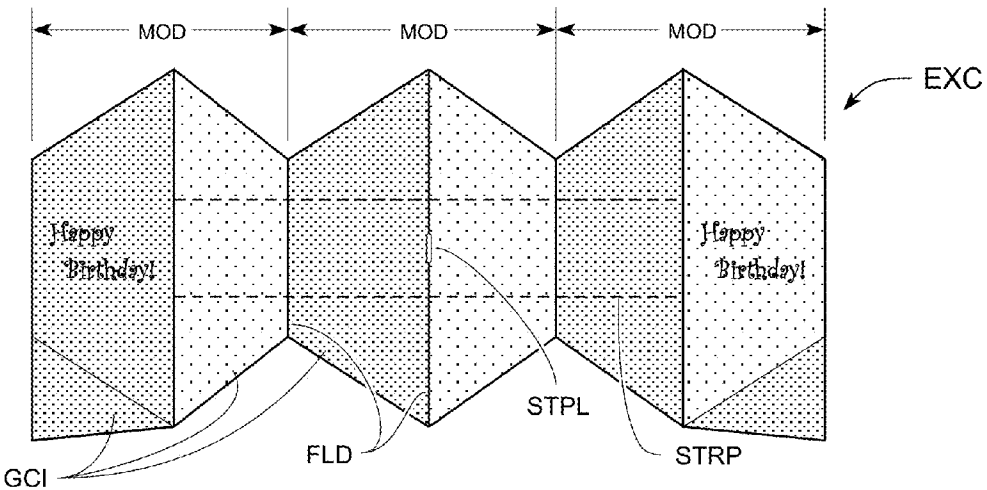
Figure 22:
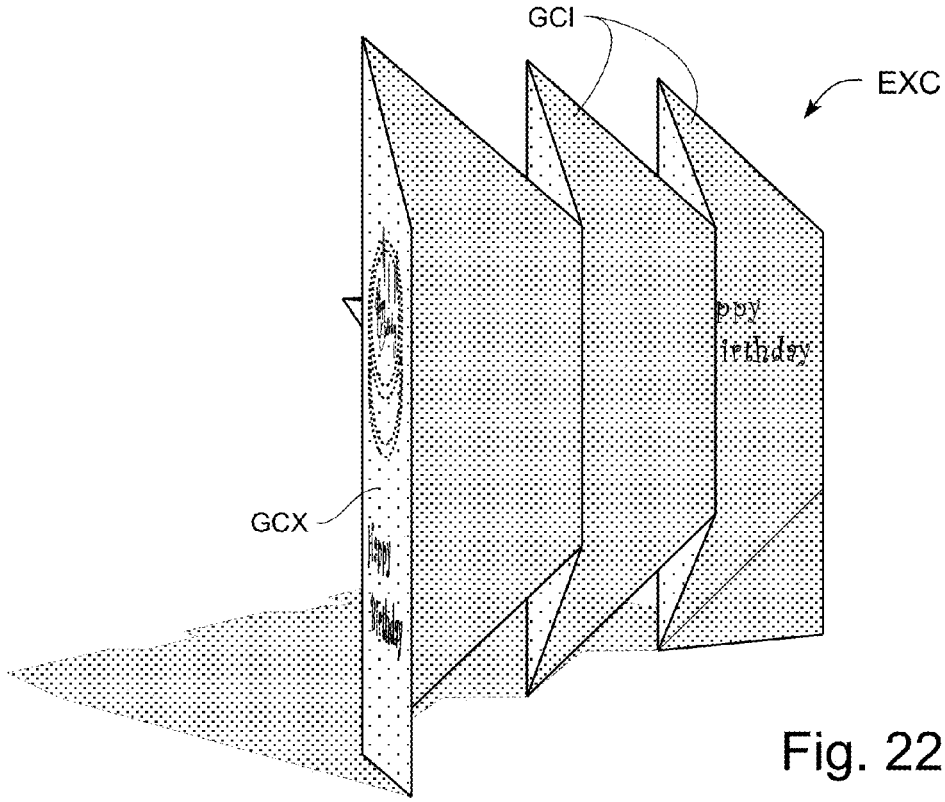

The card is supported, i.e. stands upright, on the lower edges of the double-sided front and back cover panels, FIGS. 20, 20*a*, 22, and the lower tip(s) of any intermediate long vertical edge(s).

Figure 21:
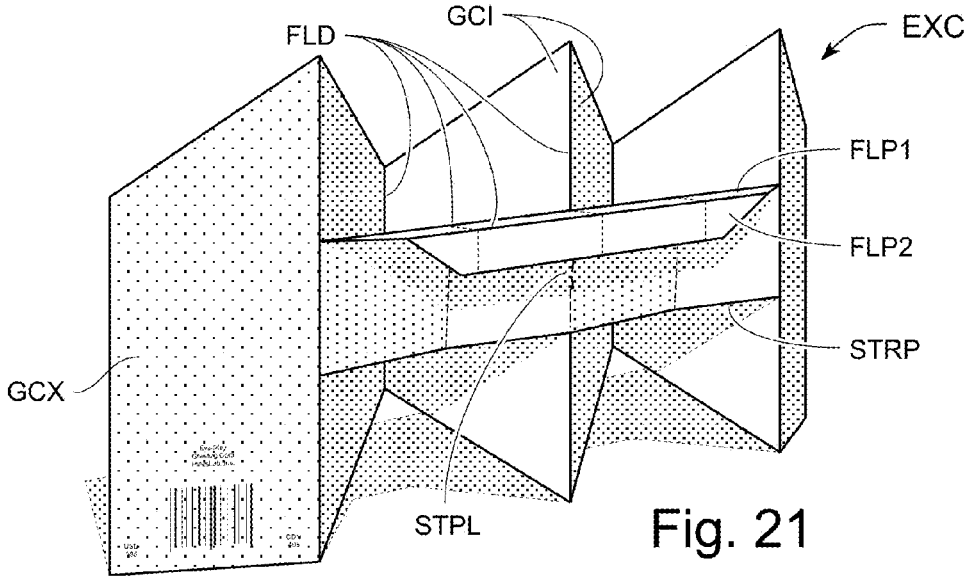
FIG. 21 is a rear view of an expanding triple-module greeting card and FIG. 22 is a front perspective view of an expanding triple-module greeting card.

The back perspective view of the card, FIG. 21, shows the strap pulled out straight at the maximum width that the card can be opened. A staple STPL is shown where the strap STRP is in contact with the fan-folded portion of the insert GCI, at the intermediate long vertical fold line FLD, FIG. 21. FIG. 22 shows the ¾-front perspective view of the fully expanded card EXC.

Figures 24, 24A:
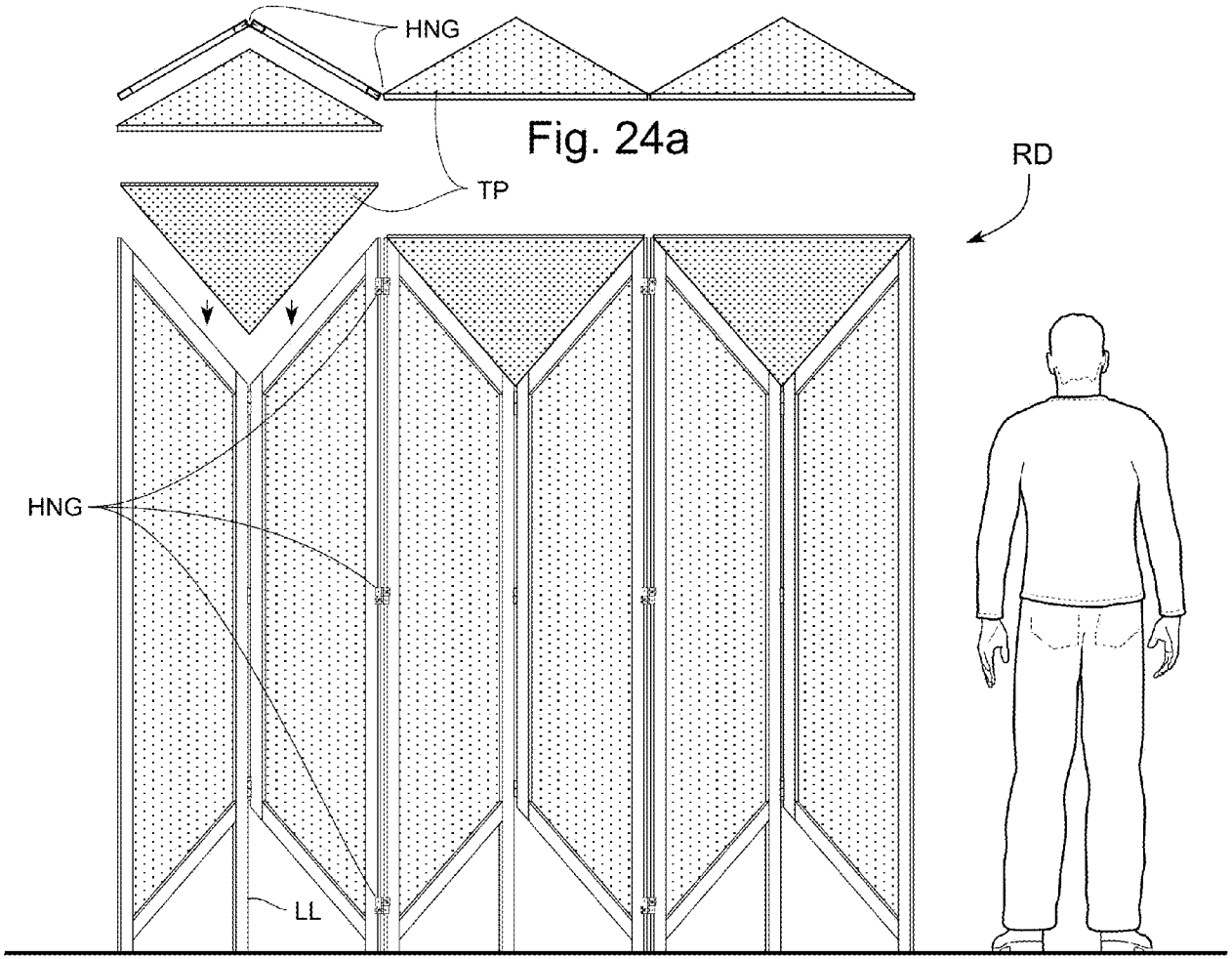

Room dividers RD provide an ideal platform for using the reverse-perspective illusion, front view FIG. 23, and rear view FIG. 24. Room dividers are sold by furniture suppliers in many designs, and are shipped fan folded flat and set up in an extended fan-folded arrangement to increase the footprint for mechanical stability. Triangular top panels TP can be attached to establish the preferred angular spacing and visual perspective. To give the room divider as clean and uncluttered look as possible, the long leg is eliminated from alternate panels. The existing long leg LL, through use of the 2-way hinges HNG, provides adequate support for that pair of panels.

Figure 25:
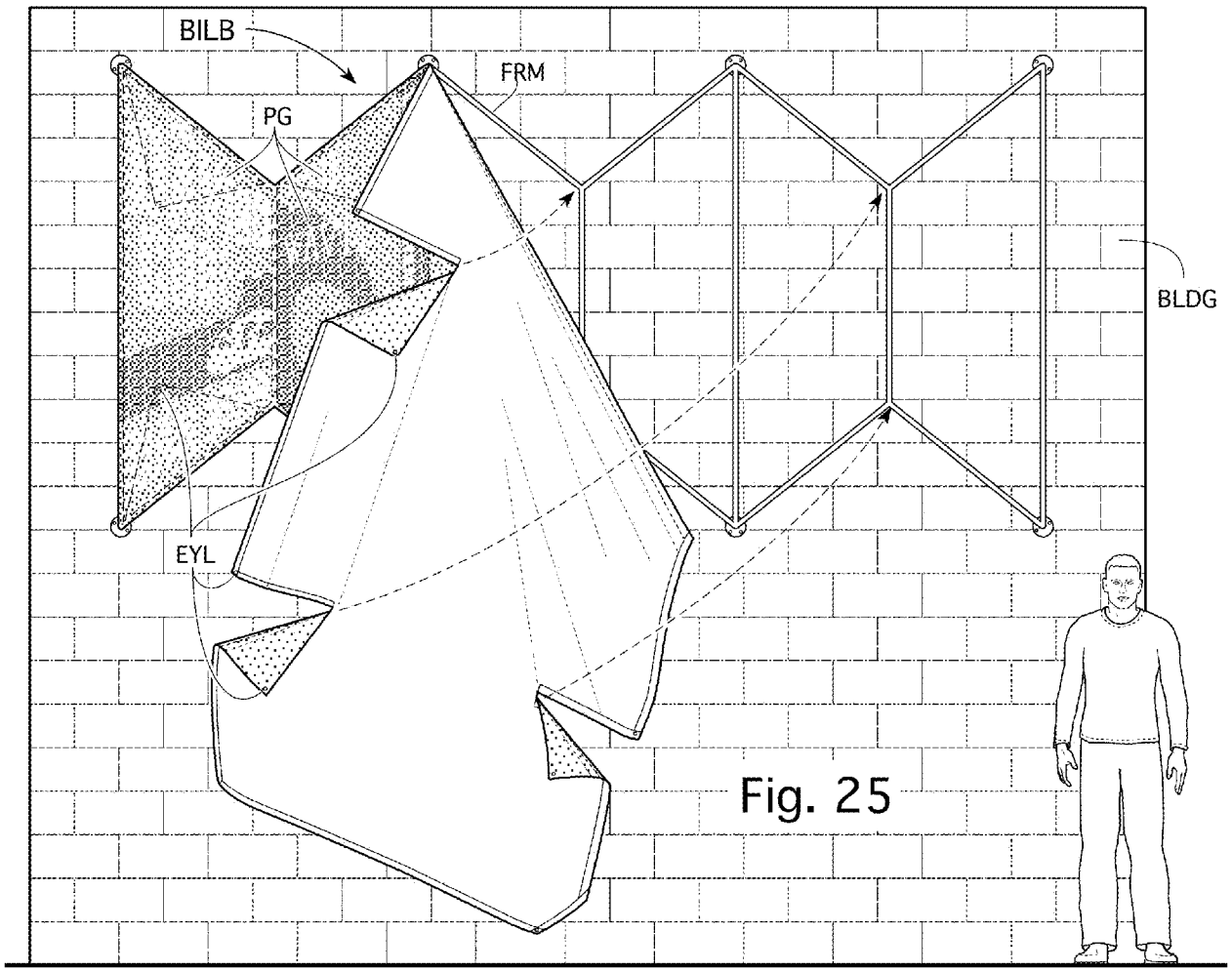
FIG. 25 is a front view that illustrates a printed banner attached to a pipe frame mounted to a wall, to create an ad or billboard.
Figure 26:
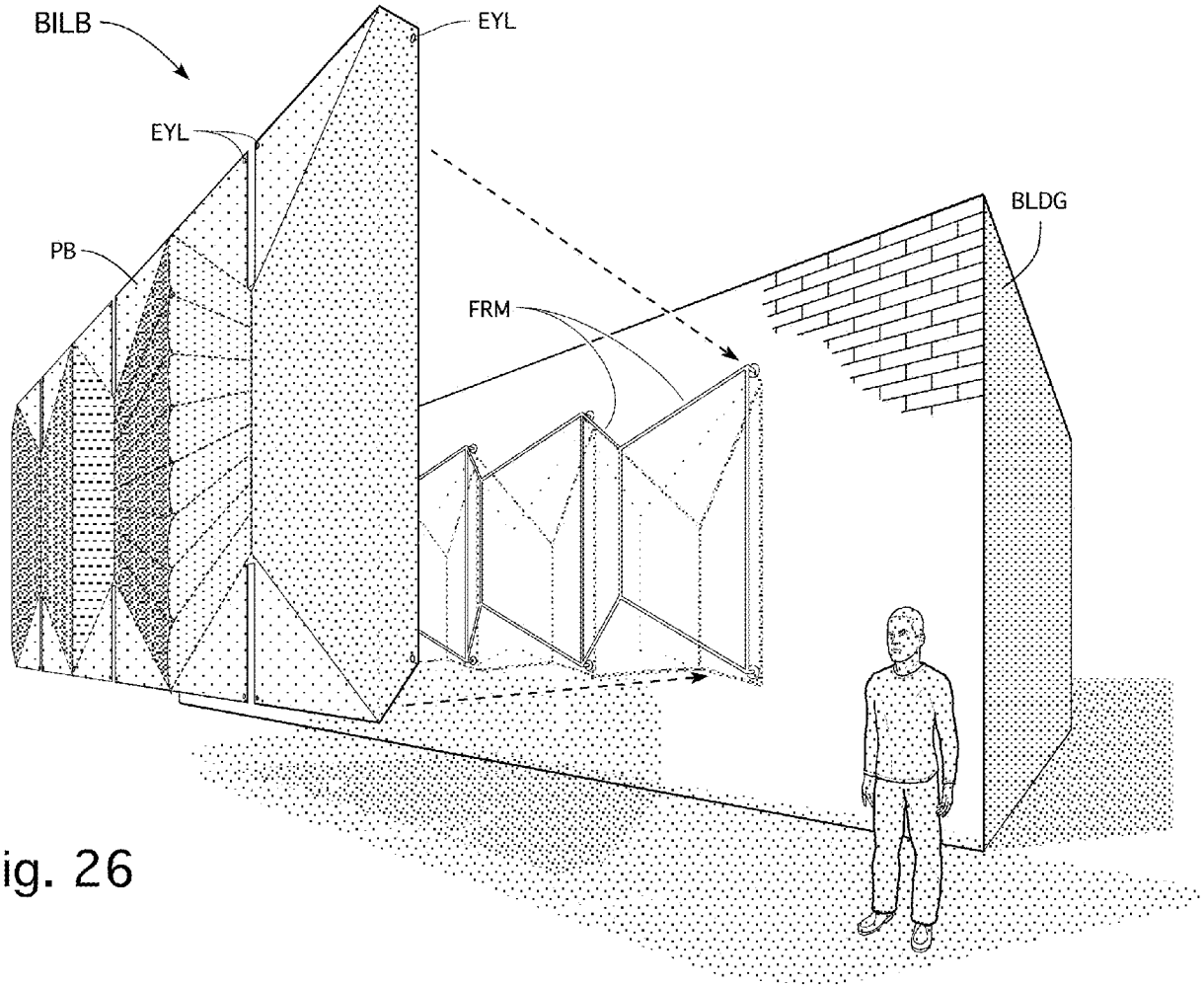
FIG. 26 is perspective view that illustrates a printed banner separated from pipe frame on a wall, to create an ad or billboard.
Figure 27:
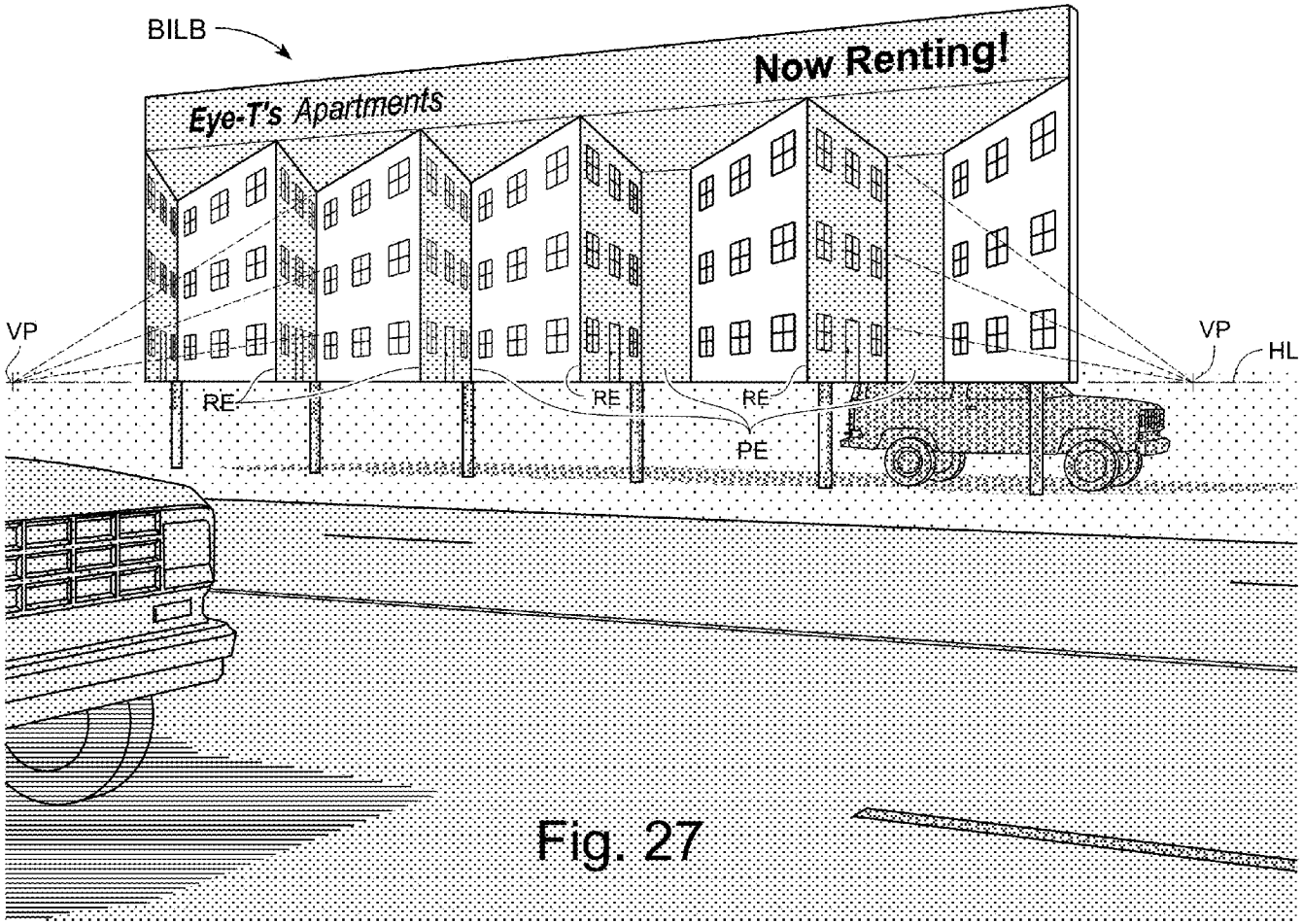
FIG. 27 is a perspective view that illustrates a reverse-perspective roadside billboard.

These signs would be extremely effective as roadside billboards BILB if they can be displayed safely, FIGS. 25, 26, 27. FIG. 27 illustrates a reverse-perspective roadside billboard of an apartment building which itself has been designed using reverse-perspective. In this unusual but fortuitous situation the bas relief billboard is in the shape of a scaled-down building being advertised. All perspective lines converge at vanishing points on the horizon line at the height of the eyes of passing motorists.

Large billboards BILB can be created economically by mounting a frame, FRM, preferably made of round pipe, to a wall and hanging a printed banner PB from it, FIGS. 25, 26. Banner materials include vinyl, non-woven reinforced vinyl and PVC fabric. FIG. 25 shows a front view of a large printed banner PB partially lashed with eyelets EYL to a pipe frame FRM which is mounted to a building BLDG. FIG. 26 is a perspective view showing the flat printed banner PB separated for clarity from the pipe frame FRM. FIG. 27 shows a reverse-perspective roadside billboard.

Figure 28:
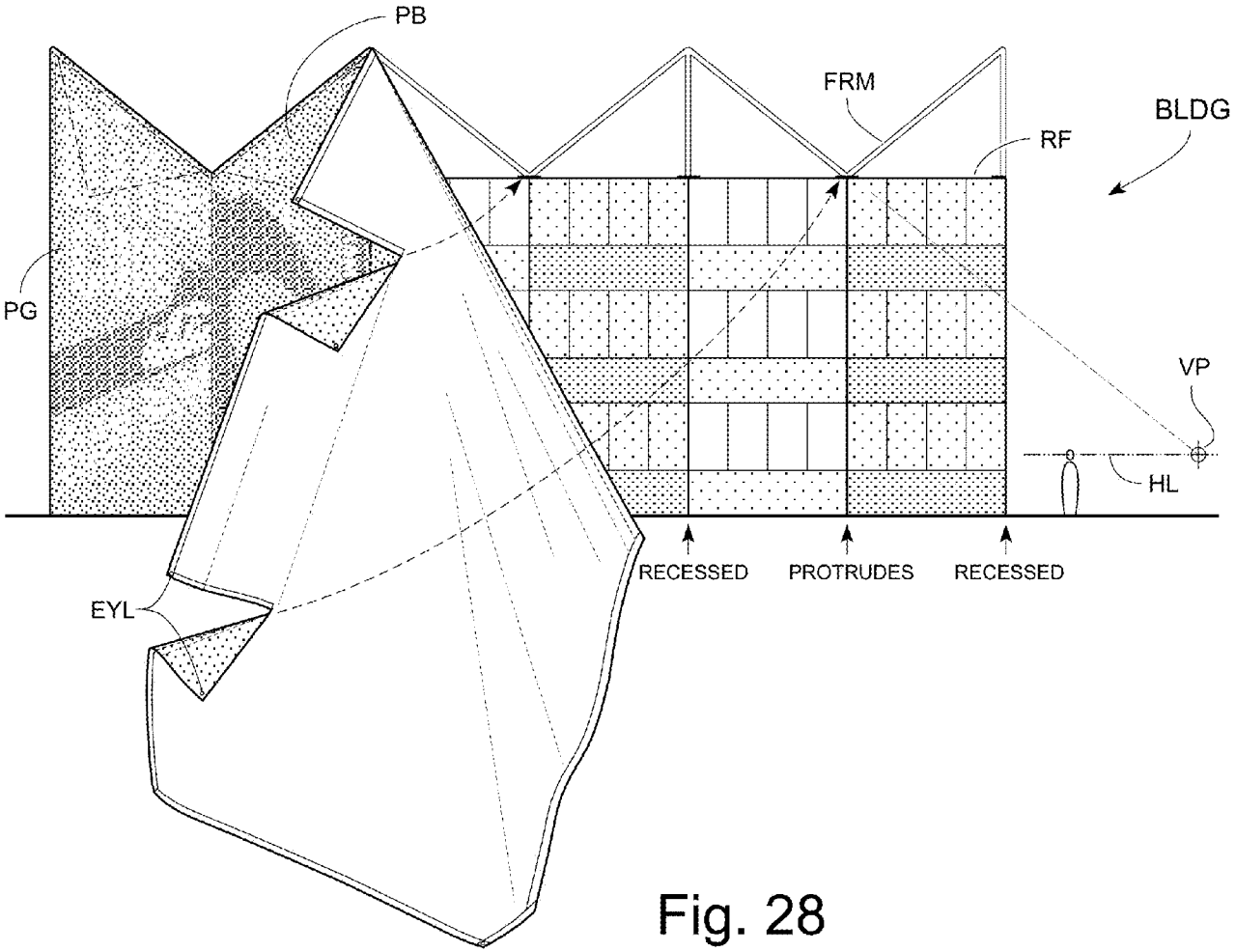
FIG. 28 illustrates the conversion of an existing building, which has a fan-folded wall, into a reverse-perspective image (using a banner with a reverse-perspective graphic).

These buildings BLDG, FIG. 28, can be converted into reverse-perspective art by attaching a frame FRM to the roof RF and hanging a large printed banner PB from the frame in front of the building. The graphics can be anything that conforms to reverse perspective, including the same building (but in reverse depth), another building, or a product that the building occupant might want to advertise. Several vendors print large full-color images on perforated see-through material including MetroMedia Technologies (www.MMT.com), Big Signs (http://BigSigns.com), and EMR Graphics (www.EMRgraphics.com).

Although the foregoing detailed description is illustrative of preferred embodiments of the present invention, it is to be understood that additional embodiments thereof will be obvious to those skilled in the art. Thus, although the preferred embodiments described herein are shown illustrating planar surfaces, non-planar surfaces might be used in specialized applications. For example, the surfaces might be molded to take on the form of a face and the graphic image displayed on the surfaces could be manipulated as herein described so that it might appear the eyes move as a person walks past the display. Such an embodiment might be particularly useful for larger displays at specialty locations where the cost of molding the surfaces can be economically justified. In addition, while the above description has set forth examples of signage that can take on various forms, those forms, except for FIGS. 4*a-c*, did not include a protruding planar element, although various types of signage could include such an element, such as, for example, banners, electronic signs, billboards and displays, and still be included within the scope of the present invention. Moreover, the inventive concepts described herein can be used architecturally to build buildings that create a reverse perspective illusion, FIG. 27. In such an environment structural aspects of the building will create the display surface and also constitute the graphic image. Further modifications are also possible in alternative embodiments without departing from the inventive concept.

Accordingly, it will be readily apparent to those skilled in the art that still further changes and modifications in the actual concepts described herein can readily be made without departing from the spirit and scope of the disclosed inventions as defined by the following claims.

What is claimed is:

1. An expandable greeting card, comprising:

a first greeting card cover;

a second greeting card cover;

a fan-folded insert connected at a first end to the first greeting card cover and at a second end to the second greeting card cover;

a display surface comprised of at least four angled surfaces that are alternately joined together so as to create a recessed element between a pair of adjacent angled surfaces of the at least four angled surfaces and a protruding element between a second pair of adjacent angled surfaces of the at least four angled surfaces relative to a substantially planar surface on which the expandable greeting card can rest in an open position, the first pair and the second pair each sharing one common angled surface and each having a non-shared angled surface;

a graphic image displayed on the display surface having a width, a height and a depth, the depth being reversed so that a distant part of an original scene of the graphic image is protruding relative to the recessed element and a near part of the original scene is recessed relative to the two protruding elements; and a support connected to the first and the second greeting card covers;

wherein the first and the second greeting card covers will hold the display surface in a free-standing and upright position relative to the substantially planar bottom surface;

wherein at least two of the at least four angled surfaces of the display surface are formed on the fan-folded insert;

wherein the support holds the display surface in an appropriate shape to create a reverse perspective illusion;

wherein the expandable greeting card can be folded up so that the display surface is not visible and the expandable greeting card has a substantially planar shape;

wherein at least one recessed element is formed in the fan-folded insert and attached to the support; and wherein the support is comprised of a planar strap.

2. The expandable greeting card of claim 1 wherein the support is further comprised of two flaps attached to the strap.

3. The expandable greeting card of claim 2 wherein the two flaps can be folded out and down to create a beam to straighten and stiffen the planar strap.

4. The expandable greeting card of claim 3 wherein the support holds the at least one recessed element formed in the fan-folded insert and the first and second ends of the fan-folded insert in a plane.

5. The expandable greeting card of claim 3 wherein the support holds each recessed element of the display surface in a plane containing the support.

6. The expandable greeting card of claim 1 wherein the support holds each recessed element of the display surface in a plane containing the support.

7. The expandable greeting card of claim 1 wherein two of the at least four angled surfaces of the display surface are formed on the first and the second greeting card covers.

8. The expandable greeting card of claim 1 wherein the fan-folded insert contains at least four of the at least four angled surfaces and two recessed elements of the display surface.

9. The expandable greeting card of claim 8 wherein the support holds the two recessed elements and the first and second ends of the fan-folded insert in a plane.

10. The expandable greeting card of claim 9 wherein a bottom point of the recessed elements rest on the substantially planar bottom surface in the free-standing and upright position.

11. The expandable greeting card of claim 9 wherein the support is comprised of a planar strap.

12. The expandable greeting card of claim 11 wherein the support is further comprised of two flaps attached to the strap that can be folded out to create a beam.

13. The expandable greeting card of claim 12 wherein the two flaps can be folded out and down to create a beam to straighten and stiffen the planar strap.

* * * * *